United States Patent [19]

Vydrin et al.

[11] 4,192,165

[45] Mar. 11, 1980

[54] ROLL MILL STAND

[76] Inventors: Vladimir N. Vydrin, ulitsa Timiryazeva, 28, kv. 27; Leonid A. Barkov, ulitsa K. Tsetkin, 30a, kv. 13; Valery V. Pastukhov, ulitsa Stalevarov, 28a, kv. 79; Sergei I. Dolgov, ulitsa Lenina, 68, kv. 20; Vladimir S. Sysoev, ulitsa Artilleriiskaya, 65b, kv. 6, all of Chelyabinsk, U.S.S.R.

[21] Appl. No.: 94

[22] Filed: Jan. 2, 1979

[51] Int. Cl.[2] ..... B21B 31/08; B21B 35/14

[52] U.S. Cl. ..... 72/238; 72/224; 72/249

[58] Field of Search ..... 72/238, 239, 224, 249, 72/248; 74/424.8 R

[56] References Cited

U.S. PATENT DOCUMENTS 3,355,923 12/1967 Gillet ..... 72/239

*Primary Examiner*—Milton S. Mehr

*Attorney, Agent, or Firm*—Fleit & Jacobson

[57] ABSTRACT

A roll mill stand comprises a housing which mounts chocks having secured therein journals carrying work rolls forming a pass, at least one of said work rolls being coupled by means of a splined joint with one end of a spindle, the other end of said spindle being connected by a splined joint to a pinion geared to a drive means. The roll mill stand is provided with an arrangement for axial displacement of the spindle, comprising a motion screw mounted coaxially with the spindle and coupled with its other end, the motion screw carrying a nut with a disk affixed to the end face thereof, the nut being mounted on a hub coupled with the spindle shaft for rotation with respect to said nut, the roll mill stand being additionally provided with a braking mechanism placed on the stationary part of the roll mill stand and cooperating with the disk of said nut, as said nut is being slowed down to disengage the spindle from the work roll.

3 Claims, 2 Drawing Figures

ROLL MILL STAND

FIELD OF THE INVENTION

The invention relates to rolling mills and more particularly to roll mill stands.

The roll mill stand according to the invention is most suitable for the manufacture of items from hard-to-deform, poorly plastic metals and alloys, such as ones based on nickel, tungsten, molybdenum and others.

Items from said materials are manufactured in wide ranges of grades and dimensions, generally in small lots, this requiring a frequent re-adjustment of passes and replacement of work rolls.

BACKGROUND OF THE INVENTION

There are known stands with a four-high pass formed with work rolls coupled with spindles geared to a drive means.

In said roll mill stands, the replacement of work rolls requires to disconnect manually couplings from the work rolls, then to install new work rolls and connect them to them to the spindles by means of couplings. In industrial practice, these operations are very labour-consuming and require much time, so lowering the efficiency of roll mill stands.

SUMMARY OF THE INVENTION

It is therefore an object of the present invention to provide a roll mill stand which would incorporate a means for automatic disconnection and connection of work rolls from and to spindles.

Another object of the invention is to reduce the time necessary to replace work rolls in roll mill stands.

Still another object of the invention is to raise the efficiency of roll mill stands.

The above and other objects are attained in a roll mill stand with a housing mounting chocks having fixed thereon journals carrying work rolls forming a pass, one at least of said work rolls being connected by means of a splined joint to one end of a spindle, the other end of said spindle being connected by a splined joint to a pinion geared to a drive means, according to the invention, the roll mill stand incorporating a device for axial displacement of said spindle, comprising a motion screw mounted coaxially with the spindle and connected to its other end, said motion screw having a nut with a disk secured to an end face thereof, said nut being installed on a hub connected to a spindle of a pinion for rotation about said pinion, and a braking mechanism placed on a fixed part of the roll mill stand and cooperating with the disk of the nut, as it is being braked to disengage the spindle from the work roll.

It is advisable to form the braking mechanism with a tongs-type gripper provided on one side with jaws having friction elements gripping flat sides of the disk of the nut, as it is being braked, and other side of the gripper being pivotally connected via rods to a spring-loaded core of a solenoid.

This type of braking mechanism is advisable for roll mill stands of relatively small size.

It is equally advantageous to provide a braking mechanism formed with a solenoid having on the magnetic core thereof a friction element cooperating with the disk of the nut, as it is being braked.

This arrangement of the braking mechanism enables pinions of a reducing gear to be accommodated within a cavity of the hub connected to the spindle, reduces the size of the roll mill stand and enhances the reliability of operation of the braking mechanism.

A roll mill stand, according to the invention, is designed for automatic disconnection and connection of the spindles from and to the work rolls, this greatly reducing roll changing time, or, in other terms, raises the efficiency of the roll mill stand.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
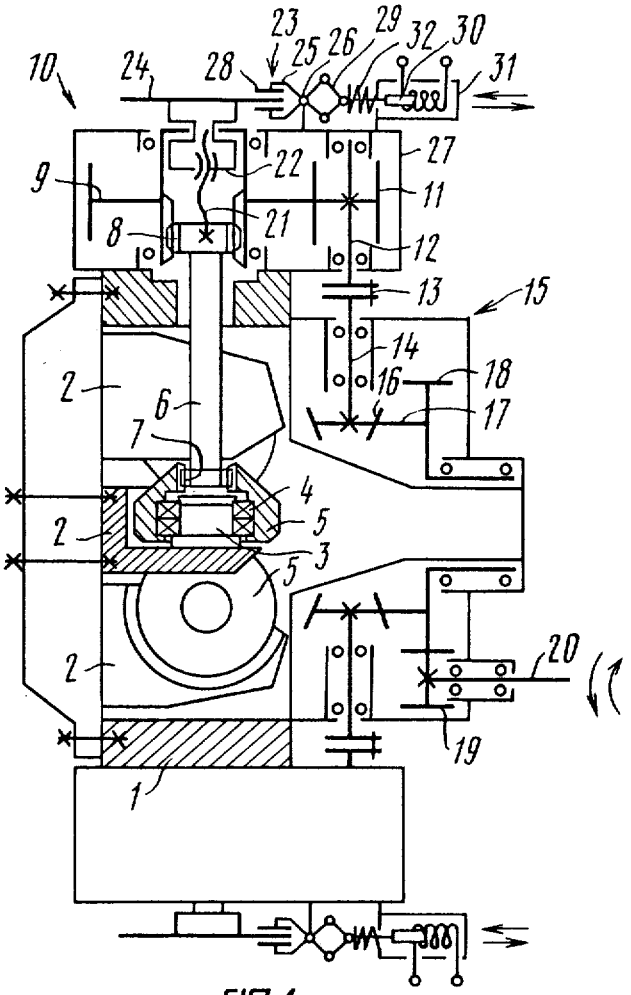
FIG. 1 depicts schematically a longitudinal section of a roll mill stand, according to the invention, with a braking mechanism formed with a tongs-type gripper.

A roll mill stand with a four-high pass comprises a housing 1 (FIG. 1) which mounts chocks 2, wherein are secured journals 3 supporting work rolls 5 in bearings 4.

All the work rolls 5 are identical, and, therefore, all that is said about a work roll in the description concerns equally all the other work rolls.

The work roll 5 is connected to one end of the spindle 6 by means of splines 7. The other end of the spindle 6 is connected to a pinion 9 located in a reduction gear 10. The pinion 9 engages a gear 11 set on a shaft 12 connected by a coupling 13 to a shaft 14 of a distributor reducing gear 15. The shaft 14 carries a bevel gear 16 meshing with a conical gear 17 which is in-line with a cylindrical gear 18 engaging a gear 19 mounted on a shaft 20 geared to a reversible electric motor (omitted).

The roll mill stand is provided with a device for axial displacement of the spindle 6, this being necessary to connect and disconnect the spindle 6 to and from the work roll 5 when replacing it.

Said device also comprises a motion screw 21 with a nut 22 and a braking mechanism 23. One end of the spindle 6 is connected to the motion screw 21. The nut 22 is mounted on a hub of the pinion 9 for rotation with respect to said hub. An end face of the nut 22 accommodates a disk 24. A braking mechanism 23 includes a tongs-type gripper 25, a pin 26 thereof being secured to a housing 27 of the reduction gear 10. Ends on one side of the tongs-type gripper 25 are provided with jaws 28 having friction elements secured thereon (omitted).

Ends on the other side of the tongs-type gripper 25 are pivotally connected via rods 29 to a core 30 of a solenoid 31. The core 30 is retained in the original position by a spring 32.

Figure 2:
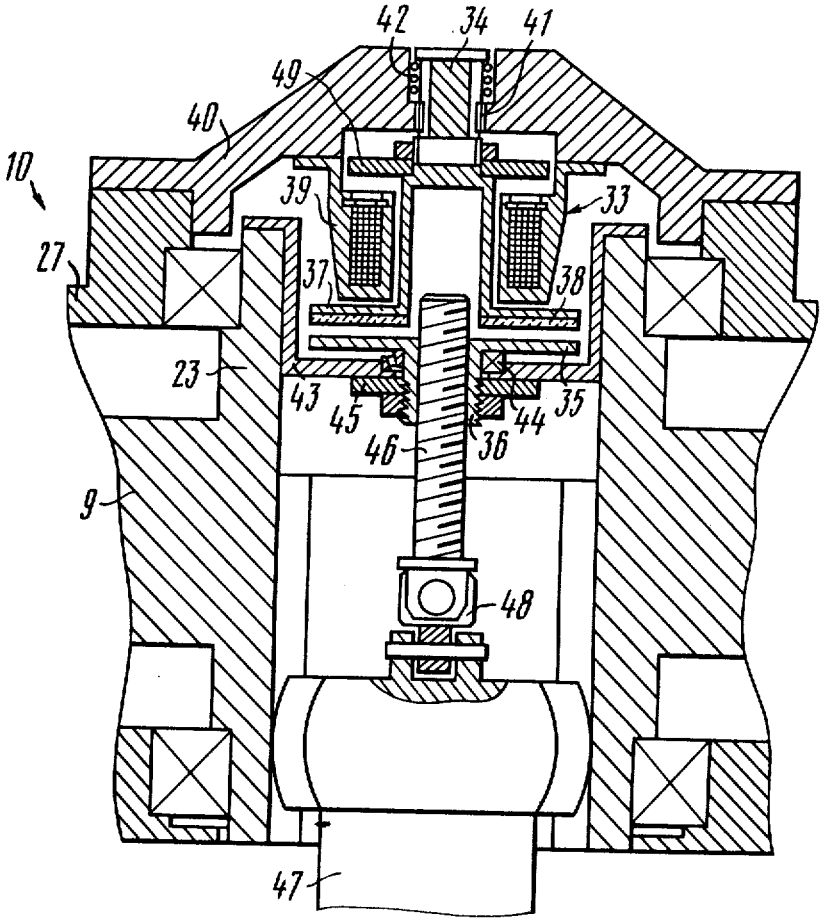
FIG. 2 is a device for axial displacement of a spindle with a braking mechanism formed with a solenoid.

In an alternative embodiment of the invention, the roll mill stand comprises a braking mechanism 33 (FIG. 2), which is a solenoid identified by the same numeral 33. An end of a core 34 of the solenoid 33 facing a disk 35 of a nut 36 is provided with a disk 37 having a friction element 38 cooperating in the process of braking with said disk 35. A coil 39 of the solenoid 33 is located inside the hub of the pinion 9 and is secured fixedly in a flange 40 of the housing 27 of the reduction gear 10. The core 34 of the solenoid 33 is connected, by means of a splined joint 41 making is slidable axially, to the flange 40 and held in the original position by a spring 42.

To accommodate the nut 36, the hub of the pinion 9 receives a part 43 which mounts rolling friction bearings 44 and sliding friction bearings 45 enabling the nut 36 to be rotated with respect to the pinion 9. A motion screw 46 is connected to the spindle 47 by means of a joint 48 designed for swivelling in two planes.

The core 34 carries a magnetic disk 49 which cooperates with the solenoid 33.

OPERATION

The roll mill, according to the invention, operates as follows.

The torque of an electric motor (omitted) is transmitted to the distributor reduction gear 15 via the shaft 20 thereof and to the gear 19, and therefrom to the cylindrical gear 18 and to the conical gear 17, which meshes with the four conical gears 16 transmitting via the shafts 14 and the couplings 13 the torque to the four reduction gears 10 via the shafts 12 carrying the gears 11 engaging the cylindrical pinions 9. The splined joint 8 transmits the torque to the spindle 6 and through the splined joints 7 to the work rolls 5.

The rolling procedure is similar to that in the known roll mills with multi-roll passes.

The work rolls 5 are replaced in the following manner. The solenoid 31 is switched on after the roll mill stand drive has been energized (the shaft 20 is in rotation). The core 30 is drawn in to compress the spring 32 and cause the rods 29 pivoting about the pin 26 to draw together the jaws 28 carrying the friction elements of the tongs-type gripper 25. The friction elements on the jaws 28 stop the rotating disk 24 secured to the nut 22 which is mounted on the hub of the pinion 9 for rotation with respect to said pinion 9. Having stopped together with the disk 24, the nut 22 imparts a translational displacement to the motion screw 21 which is rotated from the stand drive through the spindle 6. In its turn, the motion screw 21 causes a translational displacement of the spindle 6, this disconnecting or connecting the spindle 6 from or to the work roll 5 depending on the hand of rotation of the stand drive. The above device may be energized and de-energized simultaneously or individually on all the work rolls 5.

This type of braking mechanism can be installed with good advantage on roll mill stands of relatively small size.

In an alternative embodiment, the braking mechanism 33 operates as follows.

Once the roll mill stand has been started, the solenoid 33 is energized to attract the magnetic disk 49 which causes a translational displacement of the core 34, the disk 37 thereof carrying the friction element 38 being forced against the disk 35 of the nut 36 to stop the rotation of said nut 36. The core 34 is prevented from rotating by the splines 41 and is returned to original position, after the solenoid 33 is de-energized, bz the action of the spring 42. The nut 36 is mounted on the end of the disk 35 in a rolling friction bearing 44, and at the opposite end, in a sliding friction bearing 45 to avoid the nut 36 from unscrewing of itself and to ensure the rotation thereof with respect to the part 43 at the time when the braking mechanism exerts its action. The motion screw 46 is connected to the spindle 47 by means of the joint 48 slewable in two planes, said slewing motions being possible when the spindle 47 is misaligned.

A prototype roll mill stand with a four-high pass fitted with means for automatic disconnection or connection of the work rolls from and to the spindles has been manufactured according to the invention.

The devices, manufactured according to the invention, have greatly reduced roll changing time, this, in its turn, having increased the roll mill stand efficiency.

We claim:

1. A roll mill stand comprising: a housing; chocks mounted on said housing; journals fixed in said chocks; work rolls forming a pass supported by said journals; a drive means for rotating at least one of said work rolls; a spindle connected by one of its ends to one of said work rolls; a pinion connected by a splined joint to the other end of said spindle and geared to said drive means; a device for axial displacement of said spindle intended to disconnect said spindle from one of said work rolls and comprising: a motion screw mounted in-line with said spindle and connected to its other end, a nut of said motion screw mounted on the hub of said pinion for rotation with respect to said nut, a disk fixed to an end face of said nut, a braking mechanism mounted on the fixed part of said roll mill stand and cooperating with said disk of said nut as said nut is being braked to disengage said spindle from one of said work rolls.

2. A roll mill stand as claimed in claim 1, wherein the braking mechanism is a tongs-type gripper, ends on one side thereof carrying jaws with friction elements which grip the flat sides of the disk of the nut as said nut is braked, whereas the other ends on the other side are pivotally connected a rods to a spring-loaded solenoid core.

3. A roll mill stand as claimed in claim 1, wherein the braking mechanism is a solenoid, the magnetic core thereof carrying friction elements cooperating with the disk of the nut as said nut is being braked.

* * * * *